US005655402A

United States Patent [19]

Schubert

[11] Patent Number: 5,655,402

[45] Date of Patent: Aug. 12, 1997

[54] FORGING MACHINE

[76] Inventor: Peter Schubert, Kristallweg 7, 41564 Kaarst, Germany

[21] Appl. No.: 357,332

[22] Filed: Dec. 16, 1994

[30] Foreign Application Priority Data

Dec. 16, 1993 [DE] Germany ..... 43 42 924.6
Dec. 16, 1993 [DE] Germany ..... 43 42 926.2

[51] Int. Cl.[6] ..... B21J 7/16; B21J 13/03

[52] U.S. Cl. ..... 72/402; 72/447

[58] Field of Search ..... 72/402, 446, 447, 72/399, 453.01; 100/226

[56] References Cited

U.S. PATENT DOCUMENTS

| | | | |
|---|---|---|---|
| 3,313,816 | 4/1967 | Fujimoto et al. . | |
| 3,478,565 | 11/1969 | Schenk | 72/399 |
| 3,590,581 | 7/1971 | Bianchi | 100/257 |
| 3,657,916 | 4/1972 | Panhnke | 72/447 |
| 3,992,917 | 11/1976 | Kralowetz . | |
| 4,796,456 | 1/1989 | Schmoll et al. | 72/402 |
| 4,813,263 | 3/1989 | Schubert | 72/447 |
| 4,831,263 | 5/1989 | Yamashita | 72/402 |
| 4,831,864 | 5/1989 | Schmoll et al. . | |
| 5,293,769 | 3/1994 | Schubert | 72/402 |
| 5,313,816 | 5/1994 | Schubert et al. . | |

FOREIGN PATENT DOCUMENTS 1 301 790 8/1969 Germany .

*Primary Examiner*—Daniel C. Crane
*Attorney, Agent, or Firm*—Jacobson, Price, Holman & Stern, PLLC

[57] ABSTRACT

Forging machines are provided with four rams which are arranged offset at 90° to one another in a cruciform manner in one plane acting radially upon the workpiece guided longitudinally in the system axis and are equipped with tools, wherein displacement devices acting upon tool supports are provided for setting the tools with respect to the rams in accordance with the end position of the stroke of the rams. The known displacement devices have the disadvantage that the connection of the displacement devices to their drives must be provided with couplings or transmission connections which compensate the stroke of the rams. By the present invention the drives of the displacement devices are secured to the rams and push-pull rods or rotating rods are provided as drive connections with the displacement devices mounted on the front plates of the rams, for the transverse displacement of the tools. In particular, linear-stroke drives are provided which cooperate with push-pull rods as drive connections and angle-lever drives as displacement devices.

6 Claims, 5 Drawing Sheets

FORGING MACHINE

BACKGROUND OF THE INVENTION

In order to forge workpieces with a distinct longitudinal axis, use is made of forging machines provided with three or more rams which are angularly distributed in one plane transverse to said axis, and in particular four rams which are arranged offset at 90° to one another in a cruciform manner, act radially upon the workpiece which is guided longitudinally on the system axis, and are equipped with forging tools. It is structurally advantageous if the rams, guided in a machine frame, are constructed, at their ends remote from the tools, (or dies) in the form of fluid-pressure cylinders open towards the outside and containing static pistons, or are connected to such piston-cylinder units.

Because of the considerable forming capacity of these radial-forming forging machines, a high degree of confinement, preferably complete encirclement, of the workpiece has to be provided in the forming region. To this end, the tools should form a closed pass contour in adjustable inner end positions of the stroke, for which purpose the tools can be set and fixed in their common plane, transversely to the rams by means of tool supports and displacement devices acting upon the tool supports, as a function of the setting of the inner end position of the stroke of the rams, in such a way that the part of the operating face of each tool exceeding the pass-contour dimension is covered by a lateral face of the adjacent tool.

If the forging machine is to be used for open-die fine forging, it is recommended that the piston-cylinder units should be dimensioned in accordance with the operating stroke of the ram in order to minimize the compression volume, this being an essential pre-condition for rapid-stroke operation. The stroke position, by which the pass contour bounded by the tools is defined, can be set by adjustment of crossheads displaceable with respect to the machine frame and supporting the pistons of the piston-cylinder units. If, on the other hand, the forging machine is used for open-die stretch or elongation forging, the piston-cylinder units can be dimensioned for the entire ram stroke, so that fixed crossheads can be provided for supporting the pistons, and the end positions of the stroke of the rams can be set by displaceable or replaceable stops.

The invention relates to forging machines of the above-described type, and in particular to the design of the displacement devices acting upon the tool supports for setting the tools with respect to the rams in accordance with the end position of the stroke of the rams. It is known to use displacement devices which are provided with drive devices situated on the outside adjacent to the rams, as known from U.S. Pat. Nos. 4,831,864, 4,813,263 and 4,796,456, , corresponding to European Patent EP 0 228 030 B1, FIGS. 2, 8 and 9, and from U.S. Pat. Nos. 5,313,816 and is 5,293,769 corresponding to EP 0 549 825 B1. The known displacement devices have the disadvantage that the connection of the displacement devices to their drives must be provided with couplings or transmission connections which compensate or allow for the stroke of the rams and which have to be dimensioned for the total stroke of the rams when the drives are attached rigidly to the frame (EP 0 549 825B1) or at least for the operating stroke of the rams when the drives are attached rigidly to the crosshead for setting the stroke position (EP 0 228 030 B1, FIGS. 7, 8 and 9).

SUMMARY OF THE INVENTION

The invention overcomes the disadvantage described above in that the drives to the tool displacement devices are arranged at the ends of the rams which are remote from the tools and project out of the frame guiding the rams, and push-pull rods or rotating rods are provided as drive connections to the tool displacement devices, which are mounted on the front plates of the rams, for the transverse displacement of the tools.

The invention makes it possible to dispense with couplings or transmission connections which compensate the stroke of the rams. In a particularly advantageous further feature of the invention, linear-stroke drives, push-pull rods as drive connections, and angle-lever (bell-crank) drives as displacement devices are provided.

A structurally simple solution, which is at the same time particularly reliable in operation, consists according to a further feature of the invention in that piston-cylinder units with stroke stages are used as linear-stroke drive units, wherein the stroke stages correspond in number and magnitude to stages of stops for the stroke-position limits of the rams corresponding to the tool setting.

A compact, space-saving design is produced if, according to a further feature of the invention, the ram guide situated closer to the system axis is a circular guide, while the one situated further from the system axis is formed by guide plates which cooperate with four flattened portions on the ram, enlarged towards the cylinder, the push-pull rod with the linear-stroke drive being arranged outside the circular guide and between two guide plates.

In forging machines which belong to another category known in principle from German DE-B-13 01 790 and which are characterized by tools carried by support arms, it is known (U.S. Pat. No. 3,657,916=DE-A-19 08 362) to provide a transverse displacement of a tool on the support arm by means of a displacement drive which is arranged on the support arm. The tools are guided by the support arms in such a way that they always form a closed pass contour in all stroke positions. A transverse displacement of tools is therefore necessary only occasionally and only in the case where the displaceability of the pivot pins for the support arms, which is generally provided in this category of forging machines, is not provided.

In the type of forging machines to which the invention relates, the rams carrying the tools are, as mentioned, guided directly in the machine frame. It has been found that it is sufficient for the tools to form a closed pass contour in their respective innermost stroke-end positions. In order to achieve this and to prevent the tools from colliding, the setting of the tools must be constantly adapted to the stroke-end position, i.e. the tools must be displaced transversely at each pass with an altered stroke-end position. This requires displacement devices which operate rapidly, reliably and precisely.

The drives of the displacement devices are therefore moved out of the operating area, in order to protect them from the radiant heat of the forged article, and those solutions were developed which constitute the prior art described above in the Background of the Invention. The solution according to the invention is at variance with the principle of direct guidance of the rams in the machine frame, which is a structural principle of the forging machines of the category to which the invention relates and leads to the drive for the transverse displacement of the tools being secured to the support crosshead for the ram or to the machine frame. DE-A-19 08 362 does not disclose the teaching as to how a tool can be transversely displaced on a ram guided directly in the frame if the displacement device with its drive is to be moved out of the operating area.

BRIEF DESCRIPTION OF THE DRAWINGS

Embodiments of forging machines according to the invention are illustrated in the drawings, in which.

DESCRIPTION OF THE PREFERRED EMBODIMENTS

Figure 1:
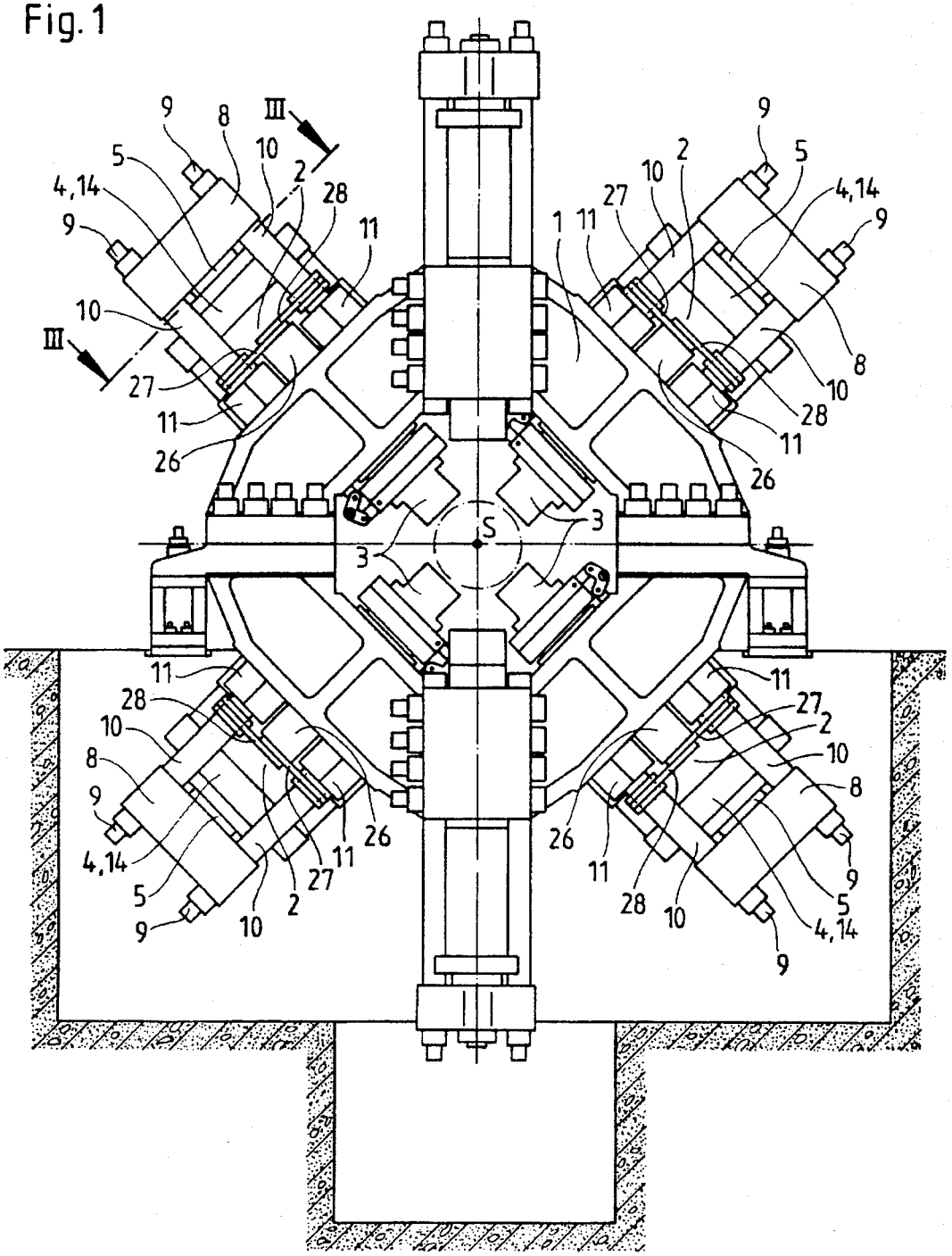
FIG. 1 is a front elevation of a forging machine viewed along the system axis S.

FIG. 1 shows a forging machine which comprises a frame 1 which guides four rams 2 in a common plane at right angles to the system axis S, the rams 2 being offset at 90° to one another in a cruciform configuration and being movable radially towards and away from the system axis S. The rams 2 are equipped with tools at their ends facing the system axis S. At their ends remote from the system axis S the rams 2 are in the form of cylinders 4 open towards the outside, i.e. they are provided with a cylinder bore **4*b* open at the end directed radially outwardly away from the axis S. The parts of the rams which form the cylinders 4 can be separate parts connected to the rams 2** proper in a releasable manner. The rams are enlarged in thickness or diameter in their end regions adjacent the cylinders.

Plunger pistons 5 with stuffing boxes 6 and seals 7 are inserted in the cylinders 4. The pistons 5 are supported on crossheads 8 which are connected by tie rods 9 to the frame with the interposition of support blocks 11 and pressure columns 10 with pre-stressing. The support blocks 11 are equipped with guide plates **11*a* which face flattened portions 4*a* on the cylinder 4, by which the cylinder 4 is guided in a manner which prevents rotation but permits axial motion, with the cooperation of the guide bush 2*a* for the ram 2. Pressure medium can be supplied to or removed from the cylinders by way of the bores 12 in the crossheads 8 and bores 13 in the pistons 5. The cylinders 4 are provided with flanges 14 which are each provided with two projections 14*a*. The rams 2 with the tools 3 are caused to return by pistons 16, which act upon the projections 14*a* and thus upon the cylinders 4 and the rams 2; the pistons 16 slide in cylinders 15 which are supported on the frame 1**.

The tools 3 should form virtually closed pass contours in the inner end position of the stroke of the rams 2. In order to be able to form closed pass contours of different cross-section without changing the tools, the tools 3 are secured to supports 17 and are displaceable therewith, in the operating plane of the tools 3, transversely to the rams 2 on front plates 18 of the rams 2; the displacement is performed to an extent which prevents a collision with the adjacent tool 3 in the end position of the stroke thereof. The transverse displacement of one tool 3 takes place as a function of the setting of the inner end position of the stroke of the adjacent tool 3, of which the unused operating width covers the facing lateral face of the first mentioned tool 3.

In the case of the embodiments illustrated in FIGS. 1, 2 to 4 and 5, the transverse displacement of each support 17 with the tool 3 is performed by a respective angle lever 19, which is mounted on the front plate 18 of the ram 2 so as to be rotatable about a pin 20, is connected to the support 17 by way of a link bar 21, and can be pivoted by a linear reciprocating drive 23 by way of a push-pull rod 22. The push-pull rod 22 and the linear reciprocating drive 23 are each arranged between two of the support blocks 11 with guide plates **11*a*. The linear reciprocating drive 23 is connected to the ram 2 by way of the ram cylinder 4 and is supported on the flange 14. The support 17 is connected to the front plate 18 of the ram 2 by clamping and locking devices (not shown) of known design which are released to enable the transverse displacement of the support 17 with the tool 3**.

Figure 2:
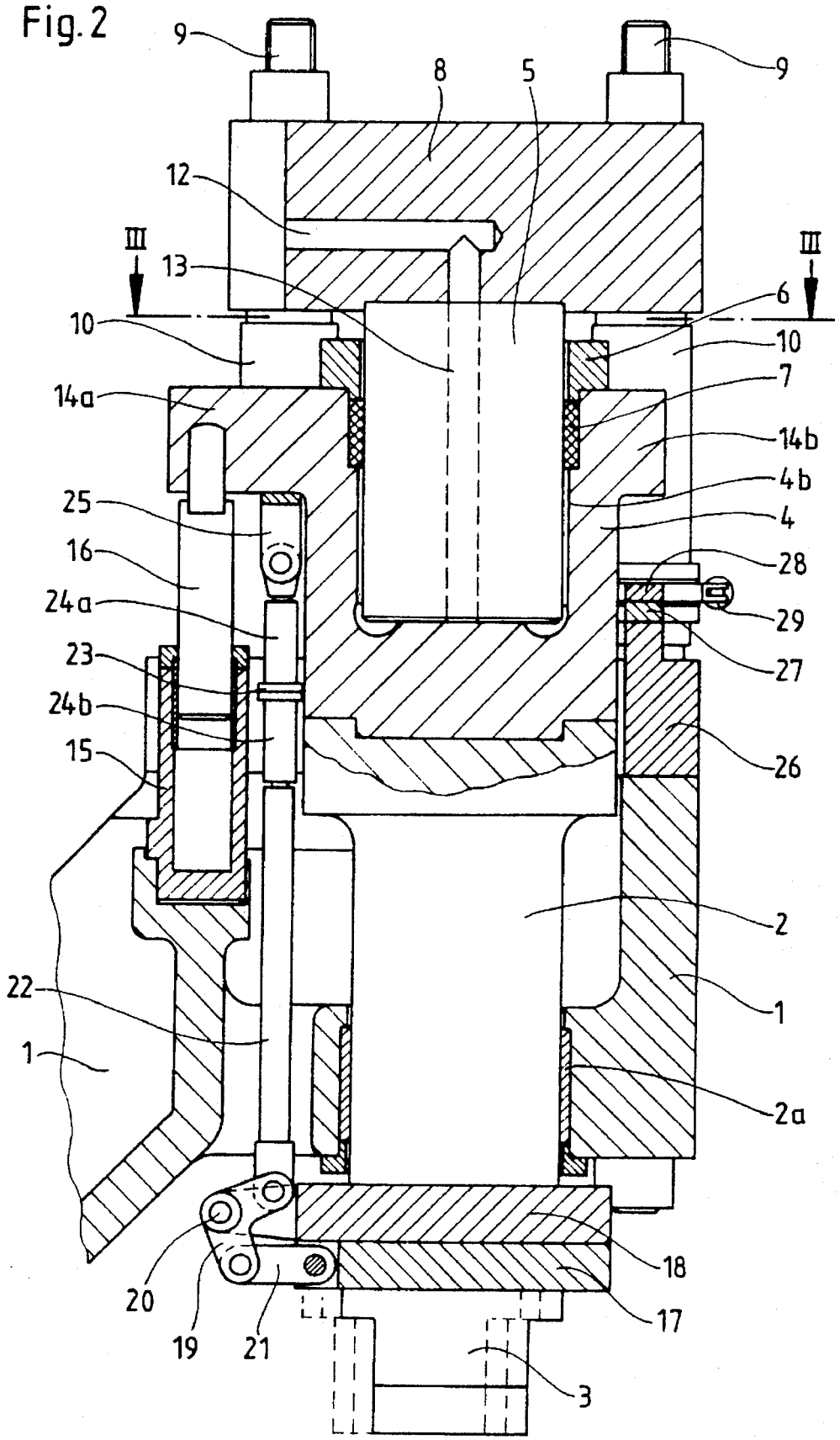
FIG. 2 is a detailed view on an enlarged scale in section in the operating plane of the tools at right angles to the system axis S, and in the upper right-hand part of FIG. 2 in a plane containing the system axis S (section line II—II in FIG. 3)
Figure 3:
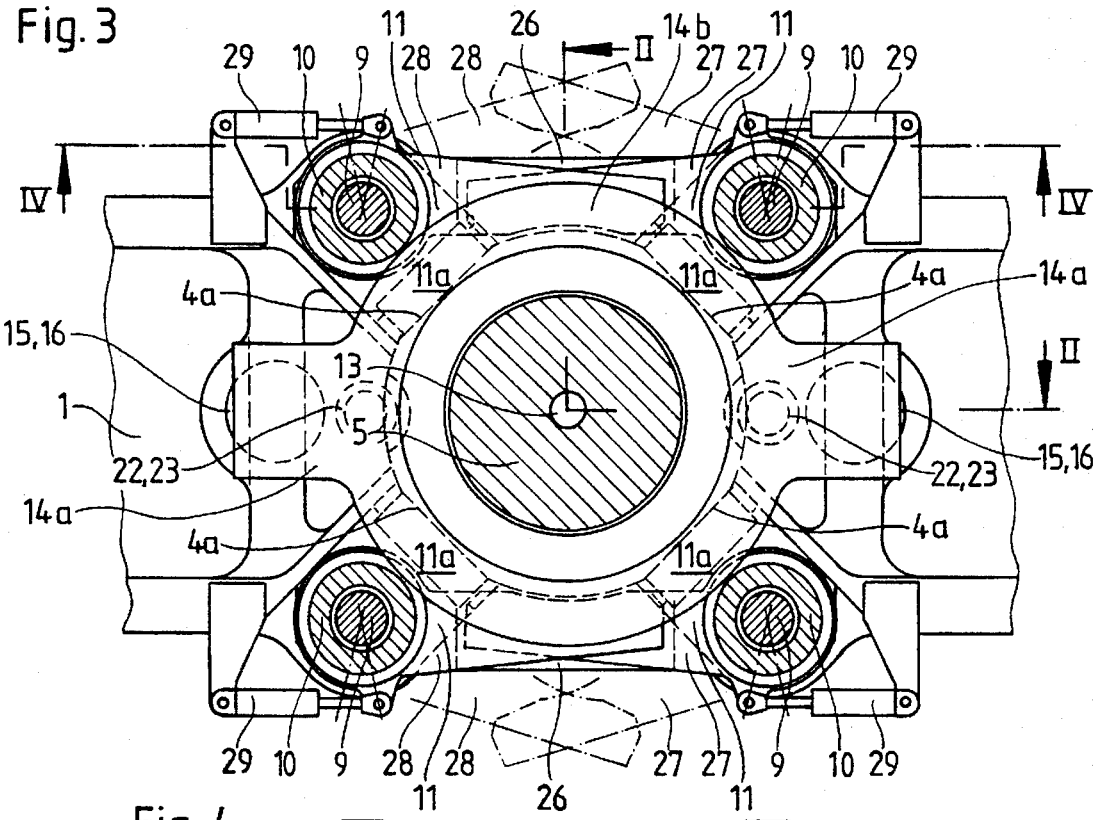
FIG. 3 is a section on the section line III—III indicated in FIGS. 1 and 2.
Figure 4:
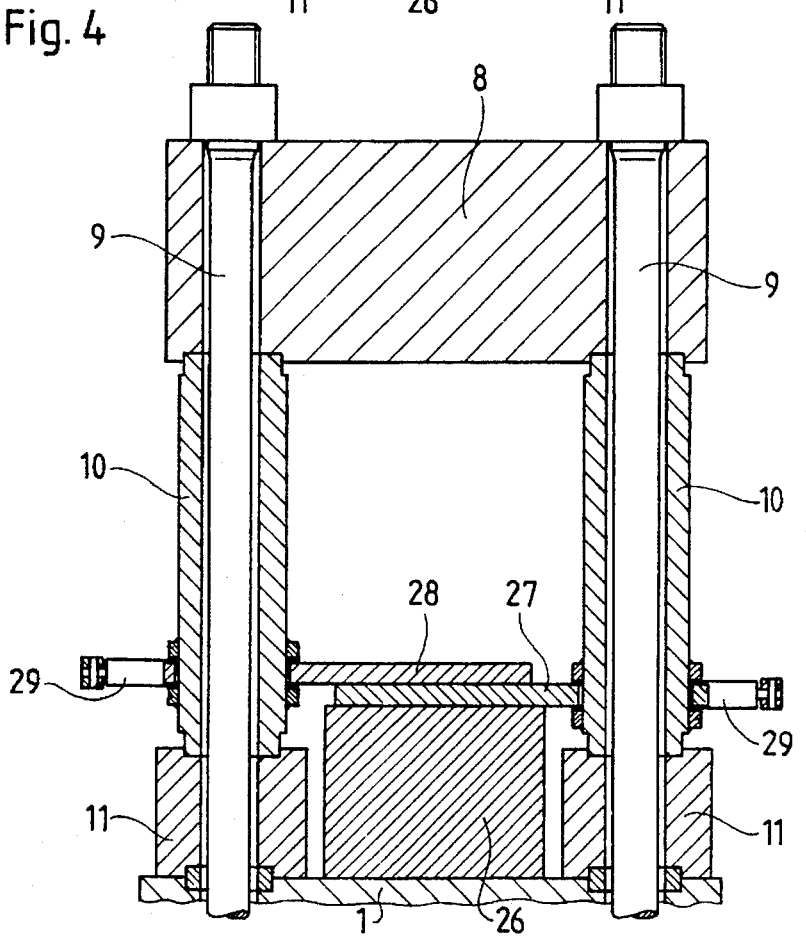
FIG. 4 is a section on the section line IV—IV indicated in FIG. 3.
Figure 5:
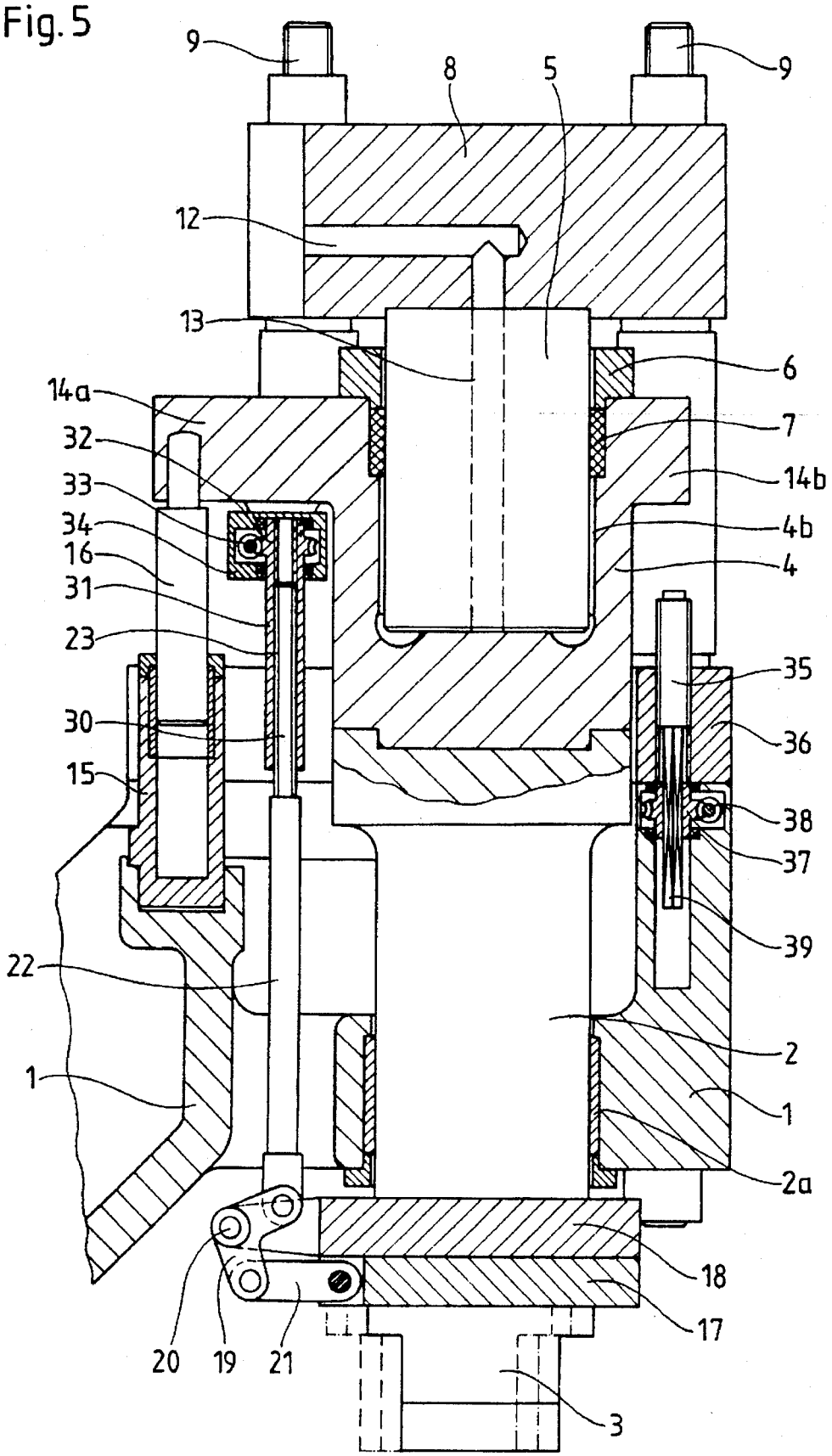
FIG. 5 shows a modification of the embodiment according to FIGS. 1 and 2 in the same sections as FIG. 2.

In the case of the embodiment illustrated in FIG. 2, the linear reciprocating drive 23 is formed by two piston-cylinder units **24*a* and 24*b* whose cylinders are joined together in tandem, the piston rod of the piston-cylinder unit 24*a* being connected to the flange 14 by way of a bearing bracket 25, while the piston rod of the piston-cylinder unit 24*b* is joined as an extension to the push-pull rod 22. Engineering one or both of the piston-cylinder units 24*a* or 24*b* results in the movement of the push-pull rod 22 through one or two piston stroke lengths, and the support 17 together with the tool 3 is accordingly moved into a first or second position of the tool 3 indicated with broken lines. The ram 2 can be moved into three pre-defined stroke-end positions corresponding to the three settings of the tool 3. To this end, a stop block 26 is secured to the frame 1 in the path of the projections 14*b* of the flanged ram cylinder 4 on both sides of the ram 2. The said stop blocks 26 fix the inner end position of the stroke of the ram 2 with the tool 3, in which they come to be at the smallest distance from the system axis S. Other end positions of the stroke of the ram 2 and tool 3, further from the axis, are determined by spacer plates 27 and 28, one or both of which can be pivoted by piston-cylinder units 29 about the columns 10 into settings above the stop blocks 26 in the path of the projections 14*b***, to reduce the stroke of the latter and hence of the tools.

In the embodiment illustrated in FIGS. 1 to 4, the transverse displacement of the tools 3 and the limitation of the stroke of the rams 2 take place in stages. The modification illustrated in FIG. 5 permits a continuous transverse displacement of the tools 3 and correspondingly a continuous limitation of the stroke of the rams 2. To this end the linear reciprocating drive 23 is constructed as a worm gear, for which purpose the rod 22 is provided with a threaded shaft 30 which engages in a threaded sleeve 31. The threaded sleeve 31 is provided with a worm-gear rim 32 and, with the associated worm 33 and a drive motor (not shown), is mounted in a housing 34, the housing 34 being supported on the flange 14 of the cylinder 4 which forms part of the ram 2. The angle lever 19 is pivoted by the rotation of the threaded sleeve 31 by way of the threaded shaft 30 and the rod 22, and the tool 3 is thereby set between the positions illustrated in FIG. 5, in accordance with the setting of continuously adjustable stops 35 for limiting the stroke of the ram 2 and the tool 3. The stops are in the form of threaded spindles 35, each of which is rotatable with its threaded shaft in a nut member 36 secured to the frame 1. The spindle is rotated, and thereby moved axially in nut member 36, by a worm gear 37 with a worm 38 and a motor (not shown). The worm gear 37 with its worm 38 is mounted in the frame 1. The threaded spindle 35 engages with a square shaft 39 in a corresponding bore in the worm gear 37.

Figure 6:
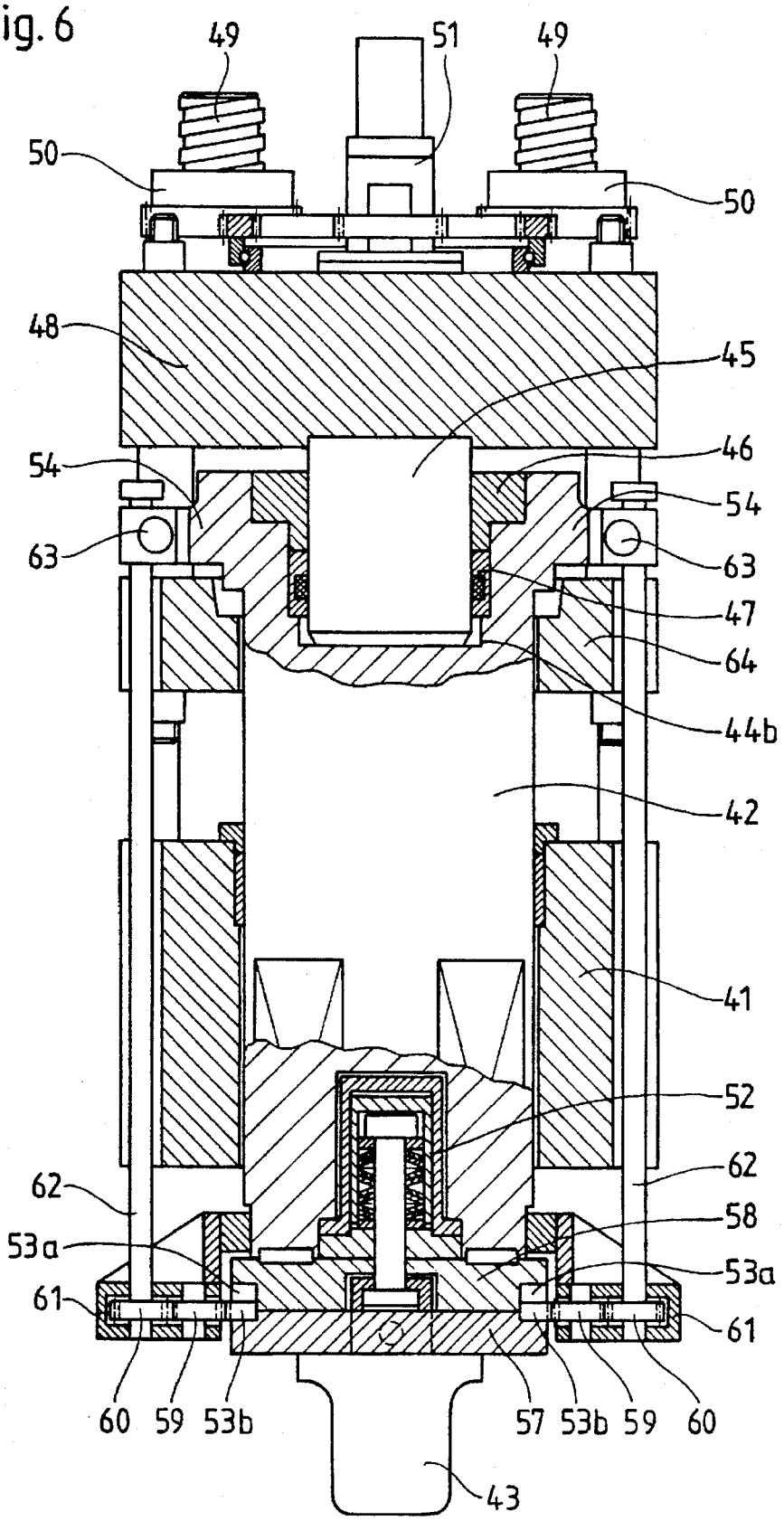
FIG. 6 shows a detail of a further embodiment, in section in a plane containing the system axis S.

FIG. 6 shows a forging machine generally as disclosed in EP 0 549 825 B1, FIGS. 1 to 6, improved by the provision of tool adjustment drives in the manner according to the invention. In this embodiment the rams 42 are guided in a frame 41 radially to the system axis of the forging machine, one of the four rams 21 being illustrated in the detailed view shown in FIG. 4. Each ram 42 is provided on its front end face with a front plate 58 used for guiding a support 57 which is displaceable transversely to the ram 42 in the operating plane (perpendicular to the plane of the illustration of FIG. 6) and supports one of the tools 43. The end of the ram 42 remote from the tool 43 is provided with a cylindrical bore 44*b* which receives a plunger piston 45 with a stuffing box 46 and a sealing ring 47, the cylindrical bore 44*b* and the piston 45 being dimensioned exclusively for the operating stroke of the ram 42. The piston 45 is supported by a crosshead 48, connected to the frame 41 by tie rods 49, the tie rods 49 being provided at their free ends with threads on which the crosshead 48 is displaceable by a drive 51 by way of nuts 50 in a known manner, and in this way the stroke position of the ram 42 is adjustable. The fixed operating stroke of the ram 42 with respect to the piston 45 and the selected position of the crosshead 48 produce, together, the desired inner end position of the stroke of the ram 42 with the tool 43.

The support 57 carrying the tool 43 is clamped against the front plate 58 of the ram 42 by a clamping device 52. Strips 53*a*, provided with fine teeth on the mutually facing faces and connected to the front plate 58, and strips 53*b*, connected to the support 57, are provided for locking the support 57 relative to the front plate 58. The strips 53b connected to the support 57 are additionally provided with lateral teeth in which pinions 59 mesh, which in turn mesh with pinions 60 and are mounted with the latter in transmission housings 61 connected to the ram 42. The pinions 59 and 60 are driven by shafts 62 to which the pinions 60 are connected in a rotationally fixed manner. Rotary drives 63, which are secured to a flange 54 on the ram 42, are provided for rotating the shafts 62. A ring 64 is provided for limiting the stroke of the ram 42 and at the same time for supporting ram return means (not shown) and connected to the crosshead 48.

This and other features of the forging machine are disclosed in copending applications Ser. Nos. DE P 43 42 924.6 and DE P 43 42 926.2 of even date herewith and entitled "Forging Machine", the contents whereof are hereby incorporated herein by reference.

I claim:

1. A forging machine comprising:

a machine frame having a system axis extending therethrough along which a workpiece is longitudinally guided;

four forging rams, each adapted to carry, in use, a tool having a working surface facing the system axis, and said surfaces adjacent said working surface, said system axis extending perpendicular to a common plane of the centers of said rams;

each ram having a ram axis and being supported and guided by said machine frame for movement along said ram axis radially towards and away from the system axis over a working stroke, each ram having a radially inner end;

pressure fluid piston and cylinder units on the machine frame each in operative driving relation with a respective said ram, each such unit having the cylinder thereof open radially outwardly and the piston thereof accommodated therein and secured to the machine frame;

stroke adjustment means for setting the radially innermost end positions of said rams relative to the machine frame;

a front plate mounted at said radially inner end of each said ram for adjustment of said tool carried thereby in use, in a direction transverse relative to the radial direction of the ram and within the said common plane, said front plate being adjustably offset from said ram axis within a working plane in dependence on the set ram innermost end position, such that tools held by said plates in use can be arranged with parts of their working surfaces overlapping side surfaces of adjacent dies to form at said innermost end positions a closed forging pass contour smaller than the working surfaces of the dies; and respective actuator means for moving each said plate in said transverse direction and each including a drive element mounted to and on the associated ram at a radially outer end region of said ram or cylinder and extending outwardly of said frame, and a connecting member mounted on said front plate of the respective ram and in operative relation with said drive element and said front plate moving the latter on actuation of the drive element.

2. A forging machine comprising:

four rams arranged in a cruciform manner in one plane, being offset at 90° to one another, to act radially upon a workpiece guided longitudinally in a system axis, said system axis extending perpendicular to a common plane of the centers of the rams, said rams being equipped with tools, said rams being guided in a machine frame by cylinders open towards the outside from the system axis or being connected to such cylinders and being adjustable in their respective stroke-end position by displacement means, said tools being displaceable in their common plane by means of tool supports on said rams set and fixed by displacement devices, acting upon said tool supports by drive connections situated outside of and adjacent to said rams, as a function of the setting of the end position of the stroke of said rams so that said tools, which with the part of their operating face exceeding a closed pass contour are covered by a lateral face of an adjacent tool, and thereby form said closed pass contour in their respective stroke-end positions, said drive connections being arranged at and on ends of said rams remote from said tools and projecting out of said machine frame and guiding said rams and one of push-pull rods and rotating rods being provided as said drive connections and with said displacement devices, mounted on front plates of said rams, for the transverse displacement of said tools.

3. A forging machine comprising:

a machine frame having a system axis extending therethrough along which a workpiece is longitudinally guided;

four forging rams, each adapted to carry, in use, a tool having a working surface facing the system axis, and said surfaces adjacent said working surface, said system axis extending perpendicular to a common plane of the centers of said rams;

each ram having a ram axis and being supported and guided by the machine frame for movement along said ram axis radially towards and away from the system axis over a working stroke, each ram having a radially inner end;

pressure fluid piston and cylinder units on the machine frame each in operative driving relation with a respective said ram, each such unit having the cylinder thereof open radially outwardly and the piston thereof accommodated therein and secured to the machine frame;

stroke adjustment means for setting the radially innermost end positions of said rams relative to the machine frame;

a front plate mounted at said radially inner end of each said ram and adapted for adjustment of a tool carried thereby in use, in a direction transverse relative to the radial direction of the ram and within said common plane, whereby the front plate can be adjustably offset from said ram axis within a working plane in dependence on the set ram innermost end position, such that tools held by said plates in use can be arranged with parts of their working surfaces overlapping side surfaces of adjacent dies to form at said innermost end positions a closed forging pass contour smaller than the working surfaces of the dies;

respective actuator means for moving each said plate in said transverse direction and each including a drive element mounted to the associated ram in a radially outer end region of said ram or cylinder extending outwardly of said frame, and a connecting member mounted on said front plate of the respective ram and in operative relation with said drive element and said front plate for moving the latter on actuation of the drive element; and each said drive element being a linear-stroke drive, said connecting members being push-pull rods, and angle-lever transmissions being provided on said front plates for coupling said rods to said tools.

4. A forging machine according to claim 3, wherein said linear stroke devices are piston-cylinder units with stroke stages providing discrete tool positions, and said machine comprises stops defining stroke-end position limits of the rams corresponding to the tool positions, the number and sizes of the stroke stages corresponding to those of said stops.

5. A forging machine comprising:

a machine frame having a system axis extending therethrough along which a workpiece is longitudinally guided;

four forging rams, each adapted to carry, in use, a tool having a working surface facing the system axis, and said surfaces adjacent said working surface, said system axis extending perpendicular to a common plane of the centers of said rams;

each ram having a ram axis and being supported and guided by the machine frame for movement along said ram axis radially towards and away from the system axis over a working stroke, each ram having a radially inner end;

pressure fluid piston and cylinder units on the machine frame each in operative driving relation with a respective said ram, each such unit having the cylinder thereof open radially outwardly and the piston thereof accommodated therein and secured to the machine frame;

stroke adjustment means for setting the radially innermost end positions of said rams relative to the machine frame;

a front plate mounted at said radially inner end of each said ram and adapted for adjustment of a tool carried thereby in use, in a direction transverse relative to the radial direction of the ram and within said common plane, whereby the front plate can be adjustably offset from said ram axis within a working plane in dependence on the set ram innermost end position, such that tools held by said plates in use can be arranged with parts of their working surfaces overlapping side surfaces of adjacent dies to form at said innermost end positions a closed forging pass contour smaller than the working surfaces of the dies;

respective actuator means for moving each said plate in said transverse direction and each including a drive element mounted to the associated ram in a radially outer end region of said ram or cylinder extending outwardly of said frame, and a connecting member mounted on said front plate of the respective ram and in operative relation with said drive element and said front plate for moving the latter on actuation of the drive element; and flanges surrounding the open outer ends of the cylinders, and guides for the rams and the cylinders, said flanges being disposed radially outwardly of said guides, said drive elements being secured on said flanges.

6. A forging machine comprising:

a machine frame having a system axis extending therethrough along which a workpiece is longitudinally guided;

four forging rams, each adapted to carry, in use, a tool having a working surface facing the system axis, and said surfaces adjacent said working surface, said system axis extending perpendicular to a common plane of the centers of said rams;

each ram having a ram axis and being supported and guided by the machine frame for movement along said ram axis radially towards and away from the system axis over a working stroke, each ram having a radially inner end;

pressure fluid piston and cylinder units on the machine frame each in operative driving relation with a respective said ram, each such unit having the cylinder thereof open radially outwardly and the piston thereof accommodated therein and secured to the machine frame;

stroke adjustment means for setting the radially innermost end positions of said rams relative to the machine frame;

a front plate mounted at said radially inner end of each said ram and adapted for adjustment of a tool carried thereby in use, in a direction transverse relative to the radial direction of the ram and within said common plane, whereby the front plate can be adjustably offset from said ram axis within a working plane in dependence on the set ram innermost end position, such that tools held by said plates in use can be arranged with parts of their working surfaces overlapping side surfaces of adjacent dies to form at said innermost end positions a closed forging pass contour smaller than the working surfaces of the dies;

respective actuator means for moving each said plate in said transverse direction and each including a drive element mounted to the associated ram in a radially outer end region of said ram or cylinder extending outwardly of said frame, and a connecting member mounted on said front plate of the respective ram and in operative relation with said drive element and said front plate for moving the latter on actuation of the drive element; and radially inner and outer ram guides, of which the inner guide situated closer to the system axis being a circular guide, and the outer guide from the system axis being formed by four guide plates, and four flattened portions on the ram in guiding relation with said guide plates respectively, enlarged towards the cylinder, said drive element being a linear-stroke drive, and said connecting member being a push-pull rod, the push-pull rod with the linear-stroke drive being arranged outside the circular guide and between two said guide plates.

* * * * *